US011193193B2

(12) United States Patent
Bach et al.

(10) Patent No.: US 11,193,193 B2
(45) Date of Patent: Dec. 7, 2021

(54) METHOD OF MANUFACTURING A WEAR-RESISTANT ALUMINIUM ALLOY PLATE PRODUCT

(71) Applicant: ALERIS ROLLED PRODUCTS GERMANY GMBH, Koblenz (DE)

(72) Inventors: Andreas Harald Bach, Koblenz (DE); Bernd Jacoby, Limburg (DE); Achim Bürger, Höhr-Grenzhausen (DE)

(73) Assignee: Aleris Rolled Products Germany GmbH, Koblenz (DE)

( * ) Notice: Subject to any disclaimer, the term of this patent is extended or adjusted under 35 U.S.C. 154(b) by 228 days.

(21) Appl. No.: 16/463,949

(22) PCT Filed: Nov. 13, 2017

(86) PCT No.: PCT/EP2017/079034
§ 371 (c)(1),
(2) Date: May 24, 2019

(87) PCT Pub. No.: WO2018/104004
PCT Pub. Date: Jun. 14, 2018

(65) Prior Publication Data

US 2020/0377985 A1 Dec. 3, 2020

(30) Foreign Application Priority Data

Dec. 8, 2016 (EP) ..... 16202838

(51) Int. Cl.
*C22F 1/047* (2006.01)
*C22C 21/08* (2006.01)

(52) U.S. Cl.
CPC ..... *C22F 1/047* (2013.01); *C22C 21/08* (2013.01)

(58) Field of Classification Search
CPC ..... C22F 1/047; C22C 21/08
See application file for complete search history.

(56) References Cited

U.S. PATENT DOCUMENTS

2003/0121571 A1* 7/2003 Lagace ..... C21D 11/005 148/508

FOREIGN PATENT DOCUMENTS

CN 1217030 5/1999
CN 101538668 9/2009
(Continued)

OTHER PUBLICATIONS

JP2008190021A English translation (Year: 2021).*
(Continued)

*Primary Examiner* — Nicholas A Wang
*Assistant Examiner* — Jiangtian Xu
(74) *Attorney, Agent, or Firm* — Kilpatrick Townsend & Stockton LLP

(57) ABSTRACT

A method of manufacturing a rolled wear-resistant aluminium alloy product including the steps of: (a) providing a rolling feedstock material of an aluminium alloy having Mg 4.20% to 5.5%, Mn 0.50% to 1.1%, Fe up to 0.40%, Si up to 0.30%, Cu up to 0.20%, Cr up to 0.25%, Zr up to 0.25%, Zn up to 0.30%, Ti up to 0.25%, unavoidable impurities and balance aluminium; (b) heating the rolling feedstock; (c) hot-rolling of the feedstock to an intermediate gauge in a range of 15 mm to 40 mm; (d) hot-rolling of the feedstock from intermediate gauge to a final gauge in a range of 3 mm to 15 mm and wherein the hot-mill exit temperature is in a range of 130-285° C.; (e) cooling of the hot-rolled feedstock to ambient temperature.

20 Claims, 1 Drawing Sheet

(56) References Cited

FOREIGN PATENT DOCUMENTS

Figure 1:
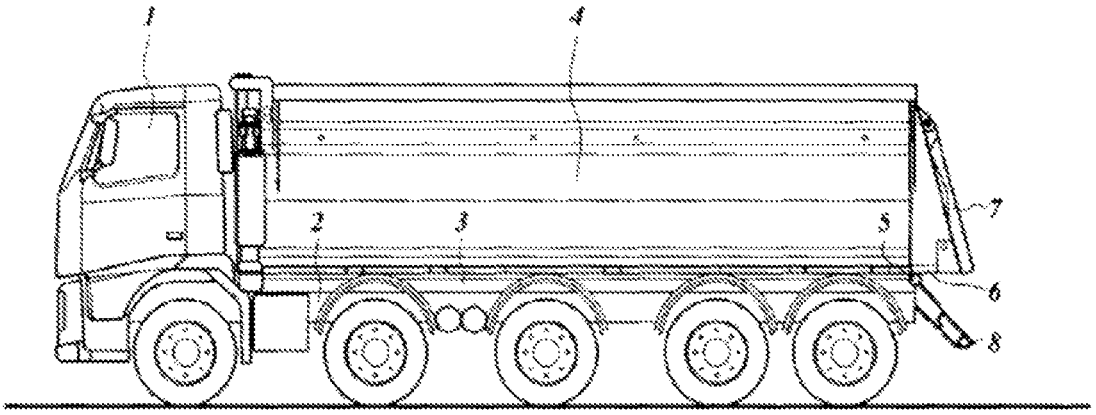

| | | | | |
|---|---|---|---|---|
| CN | 101539669 | | | 9/2009 |
| CN | 101631882 | | | 1/2010 |
| CN | 103008342 | | | 4/2013 |
| CN | 104894442 | | | 9/2015 |
| EP | 0761837 | | | 3/1997 |
| EP | 0799900 | A1 | | 10/1997 |
| JP | 2008190021 | A | * | 8/2008 |
| WO | 2008098743 | A1 | | 8/2008 |
| WO | 2016090026 | | | 6/2016 |

OTHER PUBLICATIONS

European Application No. 17797351.8, Office Action, dated May 26, 2020, 5 pages.
South African Application No. 2019/03163, Notice of Allowance, dated Jul. 24, 2020, 1 page.
International Search Report and Written Opinion dated Dec. 18, 2017 for PCT/EP2017/079034 to Aleris Rolled Products Germany GMBH filed Nov. 13, 2017.
Chinese Application No. 201780074983.5, Office Action, dated Sep. 23, 2020, 18 pages.
Chinese Application No. 201780074983.5, Office Action, dated Mar. 29, 2021, 17 pages.
European Application No. 17797351.8, Office Action, dated Mar. 5, 2021, 6 pages.
Chinese Application No. 201780074983.5, Office Action, dated Jul. 13, 2021, 13 pages.

* cited by examiner

METHOD OF MANUFACTURING A WEAR-RESISTANT ALUMINIUM ALLOY PLATE PRODUCT

CROSS-REFERENCE TO RELATED APPLICATIONS

This is a § 371 National Stage Application of International Application No. PCT/EP2017/079034 filed on Nov. 13, 2017, claiming the priority of European Patent Application No. 16202838.5 filed on Dec. 8, 2016.

FIELD OF THE INVENTION

The invention relates to a method of manufacturing a wear-resistant Al—Mg—Mn plate product. The plate material can be used amongst others for manufacturing tippers for lorries.

BACKGROUND OF THE INVENTION

Wear-resistant or abrasion-resistant aluminium alloy plate materials for tippers or tipper bodies in lorries or trucks are commonly made from Al—Mg—Mn alloys such as AA5456, AA5083, and AA5383, and being provided in an H32 temper and more preferably in an H34 temper. The H3x, wherein "x" being selected from 1 to 11, requires that the subject aluminium material at least has been hot rolled, subsequently cooled to ambient temperature, optionally inter-annealed, strain hardened by cold rolling and subjected to a final annealing heat-treatment. At least the final annealing heat-treatment is a separate batch thermal process in which coils are placed in a furnace or heater maintained at a temperature sufficient to cause recovery or final mechanical properties. Such batch thermal operation requires that the coils be heated for several hours at the correct temperature, after which such coils are typically cooled under ambient conditions. The compositional ranges of these aluminium alloys are listed in Table 1.

TABLE 1

Alloy compositions (in wt. %) of AA5456, AA5083 and AA5383, and wherein the remaining is made by impurities each <0.05, total <0.15, and the balance is made by aluminium.

| Alloying element | AA5456 | AA5083 | AA5383 |
|---|---|---|---|
| Mg | 4.7-5.5 | 4.0-4.9 | 4.0-5.2 |
| Mn | 0.5-1.0 | 0.4-1.0 | 0.7-1.0 |
| Si | <0.25 | <0.40 | <0.25 |
| Fe | <0.40 | <0.40 | <0.25 |
| Cu | <0.10 | <0.10 | <0.20 |
| Cr | 0.05-0.20 | 0.05-0.25 | <0.25 |
| Zr | — | — | <0.20 |
| Zn | <0.25 | <0.25 | <0.4 |
| Ti | <0.20 | <0.15 | <0.15 |

It is an object of the invention to provide a method of manufacturing an Al—Mg—Mn alloy plate product having a good balance of wear resistance, strength and bendability. It is another object of the invention to provide an alternative method of manufacturing an Al—Mg—Mn alloy plate product compared to the H3x production route.

DESCRIPTION OF THE INVENTION

As will be appreciated herein below, except as otherwise indicated, aluminium alloy and temper designations refer to the Aluminium Association designations in Aluminum Standards and Data and the Registration Records, as published by the Aluminium Association in 2016 and are well known to the persons skilled in the art.

For any description of alloy compositions or preferred alloy compositions, all references to percentages are by weight percent unless otherwise indicated.

The term "up to" and "up to about", as employed herein, explicitly includes, but is not limited to, the possibility of zero weight-percent of the particular alloying component to which it refers. For example, up to 0.1% Zn may include an alloy having no Zn.

As used herein, the term "about" when used to describe a compositional range or amount of an alloying addition means that the actual amount of the alloying addition may vary from the nominal intended amount due to factors such as standard processing variations as understood by those skilled in the art.

This and other objects and further advantages are met or exceeded by the present invention providing a method of manufacturing a rolled wear-resistant aluminium alloy product, ideally for use in tippers or tipper bodies, comprising the steps of:

(a) providing a rolling feedstock material of an aluminium alloy having a composition comprising of, in wt. %, Mg 4.20% to 5.5%
Mn 0.50% to 1.1%
Fe up to 0.40%, preferably up to 0.30%,
Si up to 0.30%, preferably up to 0.20%,
Cu up to 0.20%, preferably up to 0.1%,
Cr up to 0.25%
Zr up to 0.25%
Zn up to 0.30%, preferably up to 0.1%,
Ti up to 0.25%, preferably 0.005% to 0.10%,
unavoidable impurities each <0.05%, total <0.2%, balance aluminium;

(b) heating the rolling feedstock to a temperature in a range of 475° C. to 535° C.; optionally a separate homogenisation treatment is performed prior to heating the rolling feedstock to said temperature range;

(c) hot-rolling of the feedstock in one or more rolling steps to an intermediate gauge in a range of 15 mm to 40 mm, preferably 15 mm to 30 mm, and wherein preferably the hot-mill exit temperature is in a range of 370° C. to 495° C.;

(d) hot-rolling of the feedstock from intermediate gauge in one or more rolling steps to a final gauge in a range of 3 mm to 15 mm and wherein the hot-mill exit temperature is in a range of 130° C. to 285° C.; and (e) cooling, preferably air cooling, of the hot-rolled feedstock at final gauge from hot-mill exit temperature to ambient temperature, and storing. Next the cooled feedstock at final gauge is suitable for finishing operations such as levelling to improve product flatness, edge-trimming and slitting, and cut-to-length. Optionally, a recovery annealing could be applied.

The method according to this invention allows for the production of Al—Mg—Mn plate products having a tensile yield strength of at least 215 MPa, an ultimate tensile strength of at least 320 MPa, and a hardness of at least 100 HB. The method according to this invention allows for the production of Al—Mg—Mn plate products having a very good wear resistance. In addition, the method allows for the production of Al—Mg—Mn plate products having a very good bendability, in particular it allows bending angles of more than 90° at bending radii of 3.5 times, and preferable 3 times, the material thickness. The bendability is an important parameter as it allows the shaping or forming of products using the Al—Mg—Mn plate product into particular shapes instead of a welding operation.

These properties are achieved in a more efficient manufacturing process as there is no need of any cold rolling operation of the feedstock to a thinner gauge. Also the need for any final annealing heat-treatment, in particular batch annealing, after a cold rolling operation is not necessary as is required in the prior art to obtain an H3x temper such as H32 and H34. The method of the present invention can be operated more economically to provide a plate product having equivalent or superior metallurgical properties.

The Al—Mg—Mn alloy can be provided as an ingot or slab for fabrication into rolling feedstock using casting techniques regular in the art for cast products, e.g. DC-casting, EMC-casting, EMS-casting, and preferably having an ingot thickness in a range of about 220 mm or more, e.g. 400 mm, 500 mm or 600 mm. In another embodiment thin gauge slabs resulting from continuous casting, e.g. belt casters or roll casters, also may be used, and having a thickness of up to about 40 mm. After casting the rolling feedstock, the thick as-cast ingot is commonly scalped to remove segregation zones near the cast surface of the ingot.

The preheating prior to hot rolling is usually carried out at a temperature in the range of about 475° C. to 535° C. In either case, preheating decreases the segregation of alloying elements in the material as cast. In multiple steps, Zr, Cr and Mn can be intentionally precipitated to control the microstructure of the hot mill exit feedstock. If the treatment is carried out below about 475° C., the resultant homogenisation effect is inadequate. If the temperature is above about 535° C., eutectic melting might occur resulting in undesirable pore formation. The preferred time of the above preheat treatment is between 1 and 24 hours, for example 8 hours or 18 hours. The hot rolling begins preferably at a temperature above about 500° C.

In a first hot rolling operation the heated feedstock is subjected to breakdown hot rolling in one or more passes using reversing or non-reversing mill stands that serve to reduce the thickness of the feedstock to a gauge range of 15 to 40 mm, and preferably of 15 to 30 mm, and more preferably of 15 to 25 mm. The breakdown rolling starts preferably at a temperature of about 500° C. or more. Preferably the hot-mill process temperature should be controlled such that after the last rolling pass the hot-mill exit temperature of the feedstock is in a range of about 370° C. to 495° C. A more preferred lower-limit is about 400° C. A more preferred upper-limit is about 465° C.

Next after breakdown hot rolling, the feedstock is supplied to a mill for hot finishing rolling in one or more passes to a final gauge in the range of 3 to 15 mm, for example 7 mm or 10 mm. The hot finishing rolling operation can be done for example using a reverse mill or a tandem mill. Overall, the thickness of the cast rolling feedstock is typically reduced (taking processing steps (c) and (d) together) by at least about 65%, and more typically in the range of 80% to 99%. The average temperature of the hot rolled feedstock when the feedstock is inputted into process step (d) is maintained preferably at a temperature of 370° C. to 495° C. A more preferred lower-limit is about 400° C. A more preferred upper-limit is about 465° C.

Control of the hot-mill exit temperature of the rolled feedstock is important to arrive at the desired balance of metallurgical properties, and preferably the hot-mill temperature should be controlled such that after the last rolling pass the hot-mill exit temperature of the feedstock is in a range of about 130° C. to 285° C. A preferred lower-limit is about 150° C., and more preferably about 175° C. A preferred upper-limit is about 275° C., and more preferably about 250° C., and more preferably about 235° C. At a too low exit-temperature of the feedstock the strength and the hardness of the final product will be too high and adversely affecting the bendability. A too low exit temperature can also adversely affect the coiling behaviour of the feedstock during the rolling operation as well as in subsequent finishing operation. Whereas at too high exit-temperatures at least the strength and hardness of the feedstock will be too low and providing an unfavourable balance of properties.

Following the last hot-rolling step the hot-rolled feedstock at final gauge is cooled to ambient temperature. In a preferred embodiment the cooling of the hot-rolled feedstock at final gauge from hot-mill exit temperature to ambient temperature during process step (e) is by immediately coiling of the hot-rolled feedstock and allowing it to cool in an ambient environment to ambient temperature and stored.

A careful control of the hot-rolling process and the cooling to ambient temperature results in an Al—Mg—Mn plate product having a fully unrecrystallized microstructure and providing the required balance of properties including the wear- or abrasion-resistance. With fully unrecrystallized is meant that the degree of recrystallization of the microstructure is not more than about 25%, preferably not more than about 20%, and more preferably not more than 10%.

In the aluminium alloy product manufactured in accordance with the method of the invention the Mg-content should be in a range of about 4.20% to 5.5% and forms the primary strengthening element of the alloy. A preferred lower-limit for the Mg-content is about 4.6%, and more preferably about 4.75%, to provide increased wearresistance. A preferred upper-limit for the Mg-content is about 5.3%.

The Mn-content should be in the range of about 0.50% to 1.1% and is another essential alloying element. A preferred upper-limit for the Mn-content is about 0.95%, and more preferably about 0.85%, to provide a balance in strength and bendability.

To control the microstructure of the final product, next to the addition of Mn, it is preferred to have a purposive addition of either Cr or Zr each up to about 0.25% as dispersoid-forming elements. A preferred addition of Cr is in a range of about 0.05% to 0.25%, and more preferably of about 0.05% to 0.20%. When Cr is added purposively then it is preferred that the Zr level does not exceed 0.05%, and is preferably less than about 0.02%.

Ti is important as a grain refiner during solidification of both ingots and welded joints produced using the alloy product of the invention. Ti levels should not exceed about 0.25%, and the preferred range for Ti is about 0.005% to 0.10%. Ti can be added as a sole element or with either boron or carbon serving as a casting aid, for grain size control.

In an embodiment of the invention the Al—Mg—Mn alloy consists of, in wt. %: Mg 4.20% to 5.5%, Mn 0.50% to 1.1%, Fe up to 0.40%, Si up to 0.30%, Cu up to 0.20%, Cr up to 0.25%, Zr up to 0.25%, Zn up to 0.30%, Ti up to 0.25%, unavoidable impurities each <0.05%, total <0.2%, balance aluminium; and with preferred narrower compositional ranges as herein described and claimed.

The method according to this invention enables the production of Al—Mg—Mn plate material having a composition as herein described and claimed and having a tensile yield strength in the LT-direction of at least 215 MPa, preferably of at least 240 MPa, and more preferably of at least 255 MPa. The ultimate tensile strength in the LT-direction is at least 320 MPa, and preferably at least 340

MPa, and more preferably at least 360 MPa. The hardness is at least 100 HB. The wear resistance measured in a grinding wheel test using an Erichsen-317 test device (ISO 8251) is less than 0.045 g/mm, and preferably less than 0.042 g/mm, and more preferably less than 0.040 g/mm. The wear resistance measured via a Taber abraser test is less than 0.410 mg/rev, and preferably less than 0.407 mg/rev. The bending capacity in accordance with DIN-EN-ISO 7438 of the plate material is that it has bending angles of more than 90° at bending radii of 3.5 times or more of the material thickness, and preferably 3 times or more of the material thickness.

The wear-resistant plate material obtained by the method according to this invention is an ideal candidate for use for the floors and/or sides of tippers or tipper bodies on lorries and agricultural vehicles and is ideal for bulk transportation of a wide variety of products, e.g. sand, earth, gravel, bitumen, and harvested crops like corn grains, maize and potatoes.

In a further aspect of the invention it relates to a tipper or tipper body incorporating in its floor or sides at least one aluminium alloy plate product obtained by the method according to this invention.

In a further aspect of the invention it relates to the use of an aluminium alloy plate product obtained by the method according to this invention in a tipper or tipper body, incorporating said plate product in its floor or side(s).

FIG. 1 shows an example of a tipper truck with a chassis 2 and a cabin 1. The chassis 2 supports a sub frame 3. The sub frame 3 supports a tipper body 4, a hinge 5 couples the tipper body 4 to the sub frame 3. In this configuration the tipper body 4 has an overhang 6 at the back of the hinge 5 so that it extends a distance backwards from the chassis 2. At the back of the truck, there is provided a bumper 8 and a board 7 closes the tipper body 4.

Figure 2:
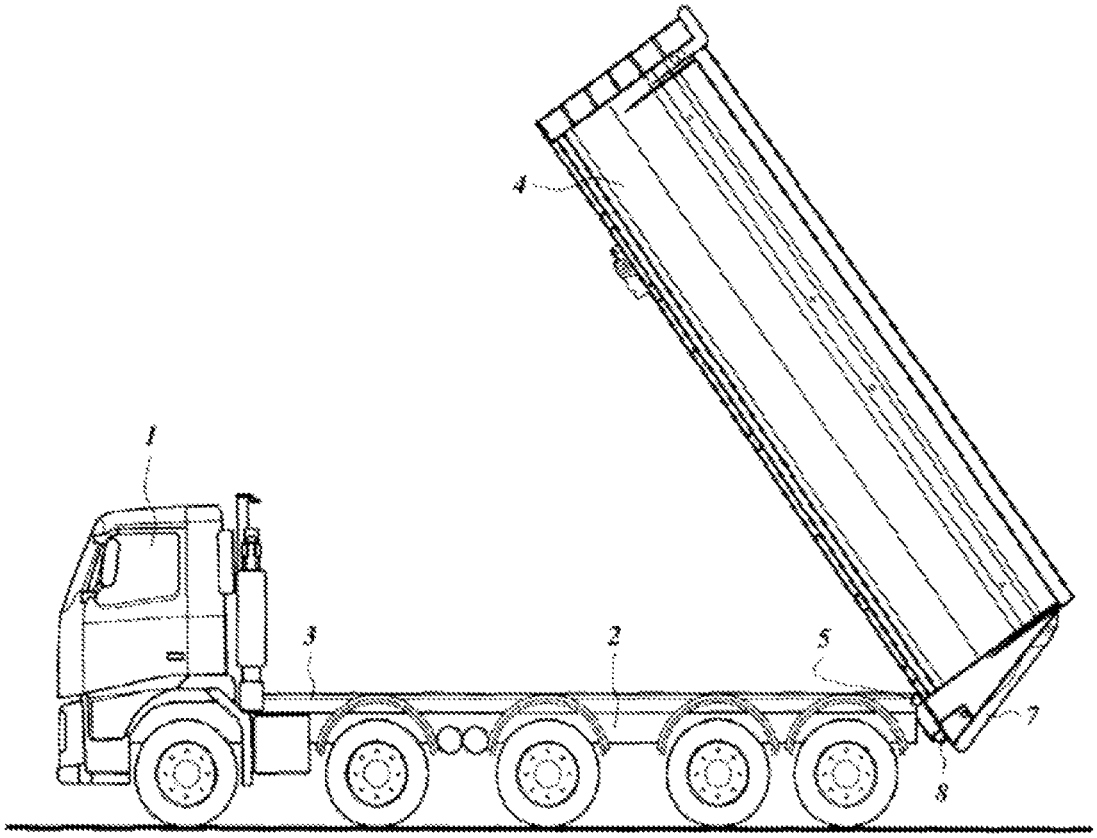

FIG. 2 shows the tipper truck of FIG. 1 wherein the tipper body 4 has been tilted.

The invention will now be illustrated with reference to non-limiting embodiments according to the invention.

EXAMPLE

The plate product obtained by the method according to this invention is compared against commercially available plate products. Alloy no. 1, 2 and 3 are comparative products and Alloy no. 4 is in accordance with this invention. Plate products of alloy no. 1, 2, and 3 had a thickness of respectively 8 mm, 7 mm, and 10 mm, and were all in the H34 condition. The plate of alloy no. 4 had a thickness of 7 mm.

Table 2 lists the nominal composition of the plate products tested. Alloy no. 1 is the nominal composition of a commercially available AA5456 alloy. Alloy no. 2 is the nominal composition of a commercially available AA5083 alloy. Alloy no. 3 is the nominal composition of a commercially available AA5383 alloy. Alloy no. 4 is the nominal composition of an alloy used for manufacturing a plate product in accordance with the invention. In accordance with the invention the alloy no. 4 had been DC-cast into a rolling ingot, scalped and heated for about 28 hours at 510° C., which temperature was also the hot-mill entry temperature and rolled down in a breakdown mill to an intermediate gauge of 18 mm and having an exit-temperature of about 450° C. Subsequently it was rolled down to 7 mm in a reverse rolling mill using an entry-temperature of 450° C. and an exit-temperature of about 230° C. and immediately coiled at this temperature for cooling down to ambient temperature. The plate material had a fully unrecrystallized microstructure. At ambient temperature the plate product was uncoiled, levelled and cut-to-length.

TABLE 2

Alloy compositions, in wt. %, balance impurities and aluminium.

| | Alloy | Mg | Mn | Si | Fe | Cu | Cr | Zn | Ti |
|---|---|---|---|---|---|---|---|---|---|
| Comp. | 1 | 4.95 | 0.61 | 0.11 | 0.29 | 0.01 | 0.1 | 0.01 | 0.02 |
| | 2 | 4.60 | 0.54 | 0.22 | 0.40 | 0.02 | 0.09 | 0.02 | 0.02 |
| | 3 | 4.82 | 0.81 | 0.10 | 0.20 | 0.05 | 0.07 | 0.07 | 0.02 |
| Inv. | 4 | 5.0 | 0.64 | 0.14 | 0.14 | 0.03 | 0.08 | 0.02 | 0.03 |

For all four plate products the mechanical properties in the LT-direction had been tested in accordance with DIN EN 10002, wherein $R_m$ is the tensile strength, $R_{0.2}$ is the yield strength and A the elongation at fracture. The results are listed in Table 3.

In Table 3 the wear resistance of the plate products measured according to two test methods are listed. The wear resistance using a grinding wheel test was conducted using an Erichsen-317 test device (ISO 8251) which involves a wheel covered with grinding paper which moves back and forth over a test sample applying a defined force. The grade of the grinding paper is specified and the same has been used for all samples. The weight loss after 10,000 double strokes with 60 grade sandpaper was defined and is referred to the width of the grinding paper as mass loss per mm (g/mm). In another wear resistance test the samples were tested using a standardized set-up according to Taber wherein two abrasion wheels with a specified surface are rotated with defined force on a rotating material sample. The two abrasion wheels are rotating in opposite directions, meaning that the material abrasion takes place crosswise. The weight loss is measured after 2,000 revolutions and is referred to the number of cycles (revolutions) as mass loss per revolution (mg/rev). The applied testing parameters were: 60 revolutions/min, number of revolutions 2,000 (resulting in a sliding path of 400 m), applied force 10N, ambient temperature, ambient medium air 25% rel. humidity, movement type: rolling, friction lane radius: 31.75 mm (U=200 mm), friction roller H-18, for each series of tests new friction rollers were used.

Also the bending capacity had been tested of all plate products in accordance with DIN-EN-ISO 7438. The plates from alloy no. 1, 2 and 3 had bending angles of more than 90° at bending radii of 4.5 times or more the material thickness, whereas the plate from alloy no. 4 had a bending angle of more than 90° at a bending radius of 3.5 times the material thickness, and in the better examples even less than 3.

TABLE 3

Test results of mechanical (in LT-direction) and wear resistance testing.

| Alloy No. | LT-$R_P$ 0.2 [MPa] | LT-$R_m$ [MPa] | LT-A [%] | Hardness [HB] | Grinding wheel test [g/mm] | Taber abraser [mg/rev] | Bending factor[1] |
|---|---|---|---|---|---|---|---|
| 1 | 277 | 376 | 15 | 107 | 0.051 | 0.429 | >4.5 |
| 2 | 226 | 322 | 16 | 89 | 0.061 | 0.461 | >4.5 |

TABLE 3-continued

Test results of mechanical (in LT-direction) and wear resistance testing.

| Alloy No. | LT-$R_P$ 0.2 [MPa] | LT-$R_m$ [MPa] | LT-A [%] | Hardness [HB] | Grinding wheel test [g/mm] | Taber abraser [mg/rev] | Bending factor[1] |
|---|---|---|---|---|---|---|---|
| 3 | 244 | 359 | 19 | 102 | 0.061 | 0.441 | >4.5 |
| 4 | 262 | 370 | 20 | 106 | 0.038 | 0.376 | 3 |

[1]Bending radius = bending factor × material thickness

From the results of Table 3 it can be seen that the plate material according to the invention has similar or better mechanical properties than the bench mark material in H34 condition in combination with a significantly increased wear resistance. Also the bendability of alloy no. 4 is significantly better resulting in improved formability. By a careful control of the hot rolling practice, the method according to this invention avoids the need for any cold rolling operation. Also the need for any final annealing treatment after a cold rolling operation has been overcome.

The wear-resistant plate material obtained by the method according to this invention is an ideal candidate for use for the floors and/or sides of tippers or tipper bodies on lorries and agricultural vehicles and is ideal for bulk transportation of a wide variety of products.

The invention is not limited to the embodiments described before, which may be varied widely within the scope of the invention as defined by the appending claims.

The invention claimed is:

1. A method of manufacturing a rolled wear-resistant aluminium alloy product comprising the steps of:

(a) providing a rolling feedstock material of an aluminium alloy having a composition comprising of, in wt. %,
Mg 4.20% to 5.5%
Mn 0.50% to 1.1%
Fe up to 0.40%
Si up to 0.30%
Cu up to 0.20%
Cr up to 0.25%
Zr up to 0.25%
Zn up to 0.30%
Ti up to 0.25%,
unavoidable impurities each <0.05%, total <0.2%, balance aluminium;

(b) heating the rolling feedstock to a temperature in a range of 475° C. to 535° C.;

(c) hot-rolling of the feedstock in one or more breakdown hot rolling steps to an intermediate gauge in a range of 15 mm to 40 mm;

(d) hot-rolling of the feedstock in a hot mill from intermediate gauge in one or more hot finishing rolling steps to a final gauge in a range of 3 mm to 15 mm and wherein a hot-mill exit temperature is in a range of 130° C. to 285° C.; and (e) cooling of the hot-rolled feedstock at final gauge, wherein after cooling the aluminium alloy product has a hardness of at least 100 HB.

2. The method according to claim 1, wherein the cooling of the hot-rolled feedstock at final gauge is by coiling of the hot-rolled feedstock.

3. The method according to claim 1, wherein during step (c) a hot-mill exit temperature is in a range of 400° C. to 465° C.

4. The method according to claim 1, wherein during step (d) the hot-mill exit temperature is in a range of 175° C. to 250° C.

5. The method according to claim 1, wherein following hot-rolling to final gauge the method is devoid of any cold rolling step(s).

6. The method according to claim 1, wherein following hot-rolled feedstock to final gauge and after cooling the aluminium alloy product is not subjected to any further heat-treatment.

7. The method according to claim 1, wherein the aluminium alloy has a Mn-content of at most 0.95%.

8. The method according to claim 1, wherein the aluminium alloy has a Mg-content of at least 4.6%.

9. The method according to claim 1, wherein the aluminium alloy has a Cr-content in a range of 0.05% to 0.20%.

10. The method according to claim 1, wherein following hot-rolled feedstock to final gauge and after cooling the aluminium alloy product has a tensile yield strength of at least 215 MPa.

11. The method according to claim 1, wherein following hot-rolled feedstock to final gauge and after cooling the aluminium alloy product has an ultimate tensile strength of at least 320 MPa.

12. The method according to claim 1, wherein following hot-rolled feedstock to final gauge and after cooling the aluminium alloy product has a wear resistance measured in a grinding wheel test using an Erichsen-317 test device (ISO 8251) of less than 0.045 g/mm.

13. The method according to claim 1, wherein following hot-rolled feedstock to final gauge and after cooling the aluminium alloy product has a bending capacity in accordance with DIN-EN-ISO 7438 of bending angles of more than 90° at bending radii of 3.5 times or more of the final gauge thickness.

14. The method according to claim 1, wherein the hot-rolling of the feedstock in one or more rolling steps is to intermediate gauge in the range of 15 mm to 30 mm, and wherein a hot-mill exit temperature of the hot rolling to intermediate gauge is in a range of 370° C. to 495° C.

15. The method according to claim 1, wherein the aluminium alloy has a Mn-content of at most 0.85%.

16. The method according to claim 1, wherein the aluminium alloy has a Mg-content of at least 4.75%.

17. The method according to claim 1, wherein following hot-rolled feedstock to final gauge and after cooling the aluminium alloy product has a tensile yield strength of at least 240 MPa.

18. The method according to claim 1, wherein following hot-rolled feedstock to final gauge and after cooling the aluminium alloy product has an ultimate tensile strength of at least 340 MPa.

19. The method according to claim 1, wherein following hot-rolled feedstock to final gauge and after cooling the aluminium alloy product has a wear resistance measured in a grinding wheel test using an Erichsen-317 test device (ISO 8251) of less than 0.042 g/mm.

20. The method according to claim 1, wherein following hot-rolled feedstock to final gauge and after cooling the aluminium alloy product has a bending capacity in accordance with DIN-EN-ISO 7438 of bending angles of more than 90° at bending radii of 3 times or more of the final gauge thickness.

* * * * *